US011450492B1

(12) United States Patent
Chu et al.

(10) Patent No.: US 11,450,492 B1
(45) Date of Patent: Sep. 20, 2022

(54) KEY STRUCTURE

(71) Applicant: Primax Electronics Ltd., Taipei (TW)

(72) Inventors: Xiao-Jun Chu, Taipei (TW); Li-Qiang Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/483,758

(22) Filed: Sep. 23, 2021

(30) Foreign Application Priority Data

Aug. 5, 2021 (CN) ..... 202110895515.2

(51) Int. Cl.

| | |
|---|---|
| ***H01H 13/14*** | (2006.01) |
| ***H01H 13/704*** | (2006.01) |
| ***H01H 13/705*** | (2006.01) |
| ***H01H 3/12*** | (2006.01) |

(52) U.S. Cl.
CPC ..... *H01H 13/14* (2013.01); *H01H 3/12* (2013.01); *H01H 13/704* (2013.01); *H01H 13/705* (2013.01)

(58) Field of Classification Search
CPC ..... H01H 13/14; H01H 3/12; H01H 13/704; H01H 13/705; H01H 13/70; H01H 13/52; H01H 13/84; H01H 13/85; H01H 2215/004; H01H 2221/062; H01H 2227/022
See application file for complete search history.

(56) References Cited

U.S. PATENT DOCUMENTS 7,173,201 B2 * 2/2007 Fukaya ..... E03D 5/105 200/6 A
7,462,796 B1 * 12/2008 Chai ..... H01H 13/705 200/341
7,687,732 B1 * 3/2010 Tabata ..... H01H 13/705 200/341

* cited by examiner

*Primary Examiner* — Lheiren Mae A Caroc
(74) *Attorney, Agent, or Firm* — Kirton McConkie; Evan R. Witt

(57) ABSTRACT

A key structure includes a switch circuit layer, a pedestal and a keycap. The pedestal includes a protrusion part and a hollow part. The keycap includes a buffering hook and a locking hook. The pedestal is disposed on the switch circuit layer. The keycap is disposed within the hollow part of the pedestal. The buffering hook and the locking hook of the keycap are aligned with the protrusion part of the pedestal. While the keycap is moved in a direction away from the switch circuit layer, the buffering hook is contacted with the protrusion part and then the locking hook is contacted with the protrusion part.

9 Claims, 4 Drawing Sheets

KEY STRUCTURE

FIELD OF THE INVENTION

The present invention relates to an input device, and more particularly to a key structure.

BACKGROUND OF THE INVENTION

Generally, a keyboard device comprises plural key structures. The key structures are fixed on a base plate through corresponding pedestals. These pedestals are disposed on a switch circuit layer. The keycaps of the key structures are disposed within the corresponding pedestals. Consequently, the keycaps can be maintained at the positions over the switch circuit layer in order to be pressed by the user. When the keycap is pressed down, a corresponding input signal is generated. Moreover, the pedestals are equipped with position-limiting elements. Due to the arrangement of the position-limiting elements, the keycaps are not detached from the pedestals. Moreover, due to the arrangement of the position-limiting element, the keycap can be moved upwardly or downwardly to the normal height after the keycap is pressed down. After the keycap is pressed down by the user and the pressing force is released, the height of the keycap is gradually increased. When the keycap is moved upwardly to the original height, the position-limiting element is contacted with the keycap to stop the keycap. Consequently, the height of the keycap is not excessively increased, or the keycap is not detached.

However, the conventional key structure still has some drawbacks. For example, when the keycap is ascended to the original height, the keycap usually knocks on the position-limiting element. While the keycap knocks on the position-limiting element, the keycap possibly rocks and generates noise. Under this circumstance, the sensitivity and the tactile feel of the key structure are deteriorated. In other words, the conventional key structure is not user-friendly.

SUMMARY OF THE INVENTION

For solving the drawbacks of the conventional technologies, the present invention provides a key structure. The key structure is equipped with a buffering structure. While the keycap is ascended and returned to its original height, the buffering structure is contacted with a position-limiting element firstly. Consequently, the ascending speed and the compact force of the keycap are reduced. Since the keycap is not directly contacted with the position-limiting element, the keycap will not rock and generate noise. In this way, the sensitivity and the tactile feel of the key structure are enhanced.

In accordance with an aspect of the present invention, a key structure is provided. The key structure includes a switch circuit layer, an elastic element, a pedestal and a keycap. The elastic element is disposed on the switch circuit layer. The pedestal is disposed on the switch circuit layer and arranged around the elastic element. The pedestal includes a protrusion part and a hollow part. The keycap is disposed within the hollow part of the pedestal and aligned with the elastic element. The keycap includes a buffering hook and a locking hook. The buffering hook and the locking hook are located beside each other and aligned with the protrusion part of the pedestal. While the keycap is moved in a direction away from the switch circuit layer, the buffering hook is contacted with the protrusion part and then the locking hook is contacted with the protrusion part.

In an embodiment, when the buffering hook of the keycap is contacted with the protrusion part, the buffering hook is subjected to elastic deformation. After the buffering hook is subjected to the elastic deformation, the locking hook is contacted with the protrusion part.

In an embodiment, the pedestal includes an inner wall, and the inner wall is arranged around the hollow part. The protrusion part is disposed on the inner wall and extended in a direction toward the hollow part.

In an embodiment, the buffering hook and the locking hook of the keycap are disposed within the hollow part and extended in a direction toward the inner wall.

In an embodiment, the keycap includes a connection post, and the connection post includes a lateral wall. The connection post is inserted into the hollow part of the pedestal. The buffering hook and the locking hook are located beside each other and disposed on the lateral wall in a side-by-side arrangement.

In an embodiment, the keycap further includes a buffering arm and a position-limiting arm. The buffering arm and the position-limiting arm are located beside each other and disposed on the lateral wall of the connection post in a side-by-side arrangement. The buffering hook is disposed on the buffering arm. The locking hook is disposed on the position-limiting arm.

In an embodiment, the buffering hook of the keycap includes a first contact surface, and the locking hook of the keycap includes a second contact surface. When the buffering hook is contacted with the protrusion part, the first contact surface of the buffering hook is contacted with the protrusion part. When the locking hook is contacted with the protrusion part, the second contact surface of the locking hook is contacted with the protrusion part.

In an embodiment, an area of the first contact surface of the buffering hook is smaller than an area of the second surface of the locking hook.

In an embodiment, the buffering hook is made of soft material.

From the above descriptions, the key structure of the present invention is equipped with a buffering structure. While the keycap is returned to its original position and the keycap knocks on the pedestal and the position-limiting element, the buffering structure can reduce the compact force and the noise.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments and accompanying drawings.

Figure 1:
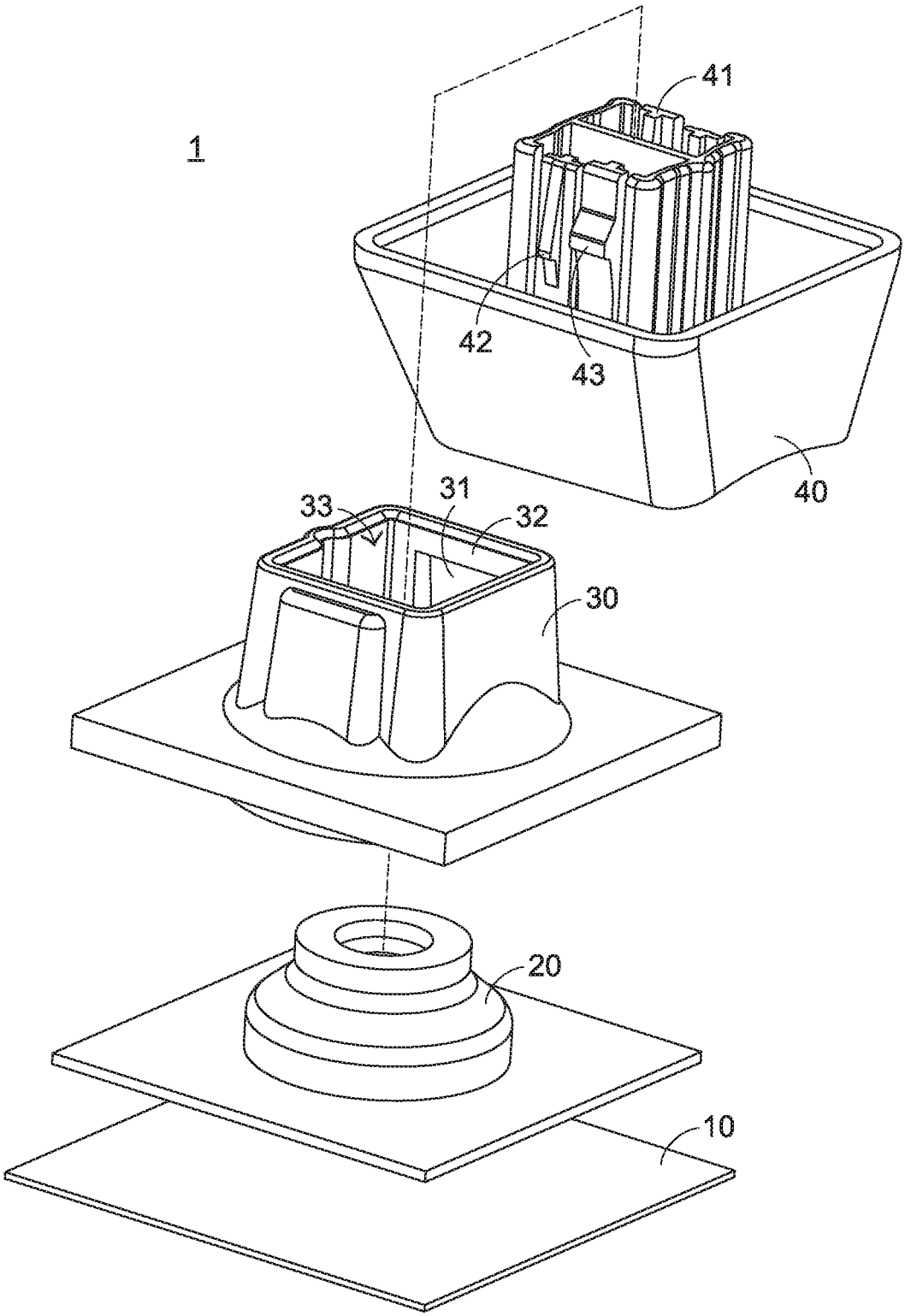
FIG. 1 is a schematic exploded view illustrating a key structure according to an embodiment of the present invention.
Figure 2:
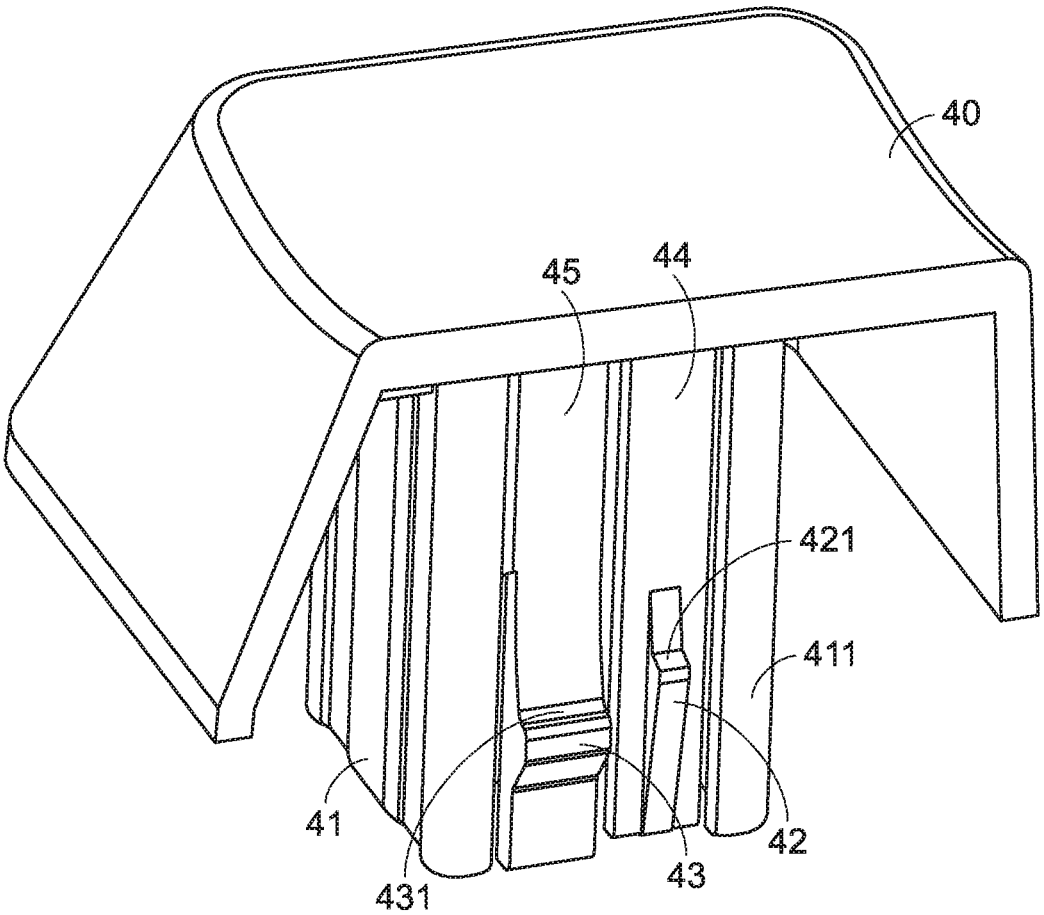
FIG. 2 is schematic cutaway view illustrating a keycap of the key structure as shown in FIG. 1 and taken along a lateral side.

FIG. 1 is a schematic exploded view illustrating a key structure according to an embodiment of the present invention. FIG. 2 is schematic cutaway view illustrating a keycap of the key structure as shown in FIG. 1 and taken along a lateral side. As shown in FIGS. 1 and 2, the key structure 1 comprises a switch circuit layer 10, an elastic element 20, a pedestal 30 and a keycap 40.

The pedestal 30 comprises a protrusion part 32 and a hollow part 33. The keycap 40 comprises a buffering hook 42 and a locking hook 43. The elastic element 20 is disposed on the switch circuit layer 10. The pedestal 30 is disposed on the switch circuit layer 10 and arranged around the elastic element 20. The keycap 40 is disposed within the hollow part 33 of the pedestal 30. The buffering hook 42 and the locking hook 43 of the keycap 40 are located beside each other. In addition, the buffering hook 42 and the locking hook 43 of the keycap 40 are aligned with the protrusion part 32 of the pedestal 30.

While the keycap 40 is moved in the direction away from the switch circuit layer 10, the buffering hook 42 of the keycap 40 is contacted with the protrusion part 32 of the pedestal 30 firstly. After the buffering hook 42 is contacted with the protrusion part 32, the locking hook 43 of the keycap 40 is contacted with the protrusion part 32 of the pedestal 30.

In an embodiment, the pedestal 30 comprises an inner wall 31, and the keycap 40 comprises a connection post 41, a buffering arm 44 and a position-limiting arm 45. The connection post 41 comprises a lateral wall 411. The buffering hook 42 of the keycap 40 comprises a first contact surface 421. The locking hook 43 of the keycap 40 comprises a second contact surface 431. The hollow part 33 is enclosed by the inner wall 31 of the pedestal 30. The protrusion part 32 is disposed on the inner wall 31 of the pedestal 30 and extended in the direction toward the hollow part 33.

The buffering arm 44 and the position-limiting arm 45 of the keycap 40 are located beside each other. In addition, the buffering arm 44 and the position-limiting arm 45 are disposed on the lateral wall 411 of the connection post 41 in a side-by-side arrangement. The buffering hook 42 is disposed on the buffering arm 44. The locking hook 43 is disposed on the position-limiting arm 45. In other words, the buffering hook 42 and the locking hook 43 are located beside each other and arranged side by side. The keycap 40 is disposed within the hollow part 33 of the pedestal 30. The connection post 41 of the keycap 40 is inserted into the hollow part 33 of the pedestal 30. The buffering hook 42 and the locking hook 43 are also disposed within the hollow part 33 of the pedestal 30. Moreover, the buffering hook 42 and the locking hook 43 are extended in the direction toward the inner wall 31 of the pedestal 30.

While the keycap 40 is moved in the direction away from the switch circuit layer 10 and the keycap 40 is ascended to a certain height, the first contact surface 421 of the buffering hook 42 of the keycap 40 is contacted with the protrusion part 32 of the pedestal 30. Consequently, the moving speed of the keycap 40 is slowed down. In addition, since the buffering hook 42 is subjected to elastic deformation, the compact force on the pedestal 30 is reduced. After the first contact surface 421 of the buffering hook 42 is contacted with the pedestal 30, the second contact surface 431 of the locking hook 43 is contacted with the protrusion part 32. Due to this structural design, the locking hook 43 is not directly contacted with the pedestal 30. Consequently, a buffering function is achieved.

Figure 3:
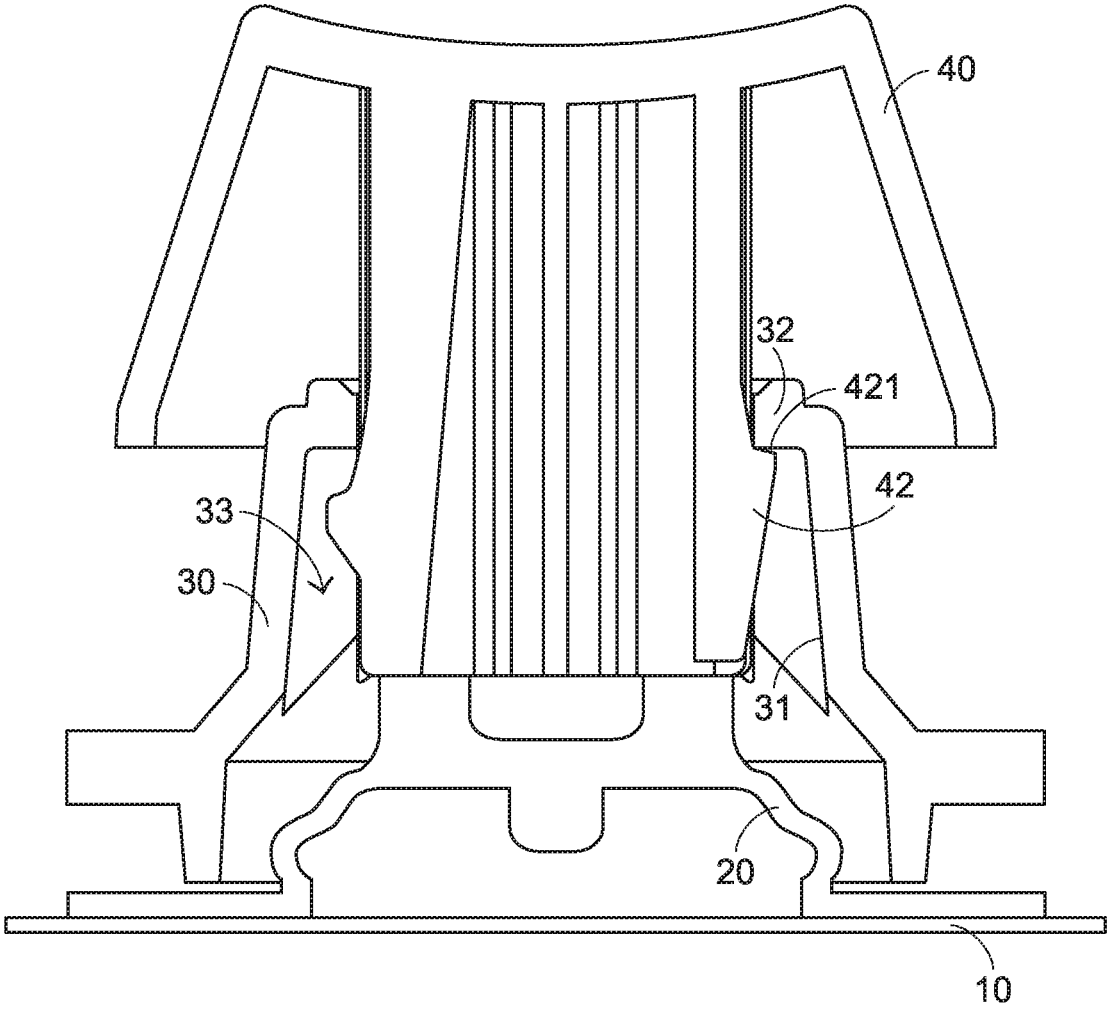
FIG. 3 is a schematic cross-sectional view illustrating the operations of the key structure according to the embodiment of the present invention.
Figure 4:
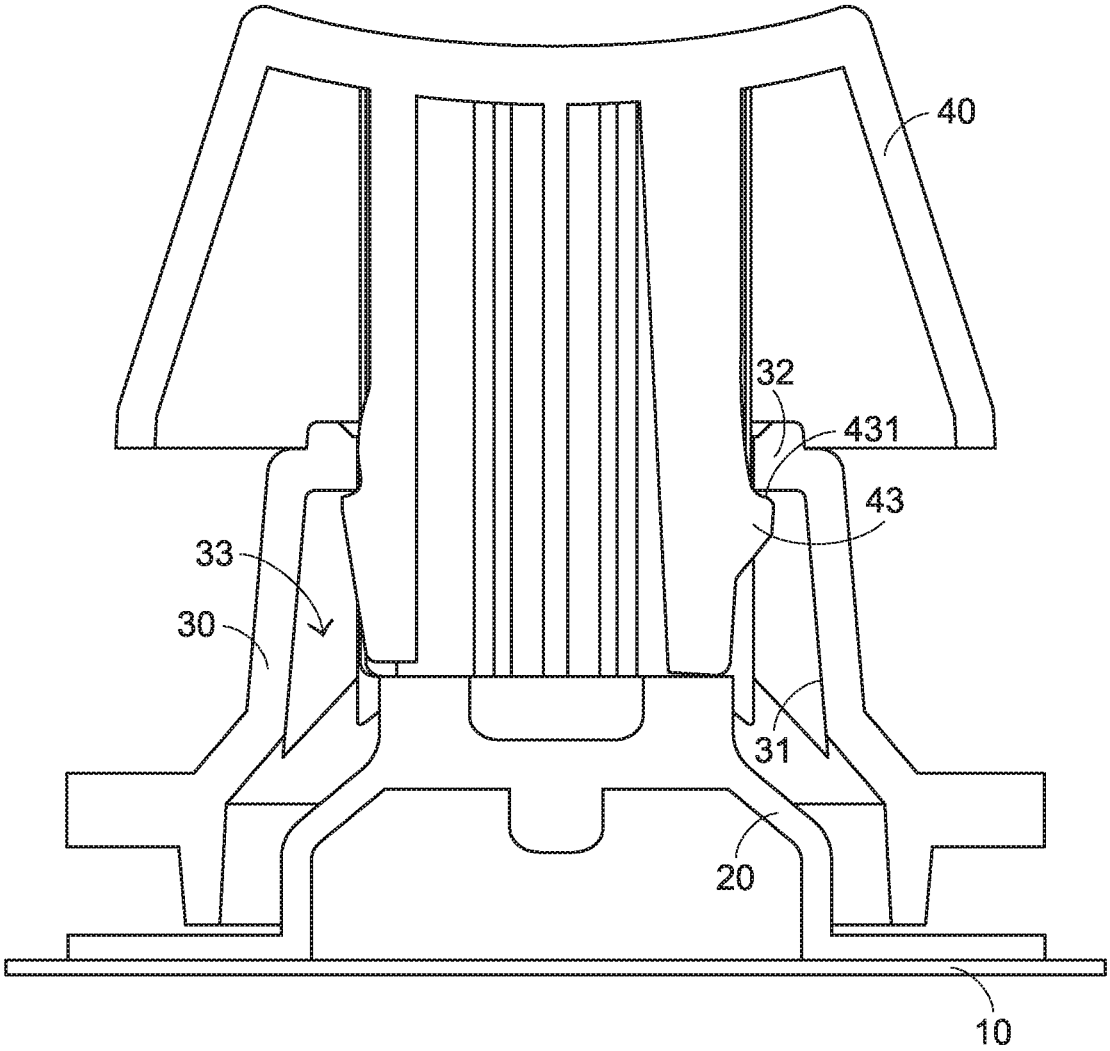
FIG. 4 is a schematic cross-sectional view illustrating the operations of the key structure according to the embodiment of the present invention.

The operations of the key structure 1 will be described as follows. FIGS. 3 and 4 are schematic cross-sectional views illustrating the operations of the key structure according to the embodiment of the present invention.

Please refer to FIG. 3. After the keycap 40 is pressed down by the user and the pressing force is released, the keycap 40 is pushed by the elastic element 20 under the keycap 40 and moved in the direction away from the switch circuit layer 10. When the keycap 40 is ascended to a certain height, the first contact surface 421 of the buffering hook 42 is contacted with the protrusion part 32 of the pedestal 30 firstly. Consequently, the moving speed and the compact force of the keycap 40 are reduced. Since the keycap 40 has not been returned to its original height, the keycap 40 is continuously pushed by the elastic element 20. Since the keycap 40 is pushed by the elastic element 20, the buffering hook 42 is subjected to elastic deformation in response to the pushing force. Consequently, the keycap 40 can be continuously ascended for a tiny height.

Please refer to FIG. 4. Until the keycap 40 is moved to its original height, the second contact surface 431 of the locking hook 43 is contacted with the protrusion part 32 of the pedestal 30. Meanwhile, the keycap 40 is no longer pushed by the elastic element 20. Moreover, since the locking hook 43 is pushed against the protrusion part 32 of the pedestal 30, the keycap 40 can be maintained at the original height, and the keycap 40 will not be detached from the pedestal 30.

In an embodiment, the buffering hook 42 of the keycap 40 is made of soft material, and the area of the first contact surface 421 of the buffering hook 42 is smaller than the area of the second contact surface 431 of the locking hook 43. In other words, the contact area of the buffering hook 42, and the flexibility of the buffering hook 42 is high. Consequently, when the buffering hook 42 is contacted with the protrusion part 32 of the pedestal 30, the compact force can be effectively alleviated, and the vibration noise can be reduced. Moreover, the locking hook 43 is made of hard material.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a switch circuit layer;

an elastic element disposed on the switch circuit layer;

a pedestal disposed on the switch circuit layer, and arranged around the elastic element, wherein the pedestal comprises a protrusion part and a hollow part; and a keycap disposed within the hollow part of the pedestal and aligned with the elastic element, wherein the keycap comprises a buffering hook and a locking hook, and the buffering hook and the locking hook are located beside each other and aligned with the protrusion part of the pedestal, wherein while the keycap is moved in a direction away from the switch circuit layer, the buffering hook is contacted with the protrusion part and then the locking hook is contacted with the protrusion part.

2. The key structure according to claim 1, wherein when the buffering hook of the keycap is contacted with the protrusion part, the buffering hook is subjected to elastic deformation, wherein after the buffering hook is subjected to the elastic deformation, the locking hook is contacted with the protrusion part.

3. The key structure according to claim 1, wherein the pedestal comprises an inner wall, and the inner wall is arranged around the hollow part, wherein the protrusion part is disposed on the inner wall and extended in a direction toward the hollow part.

4. The key structure according to claim 3, wherein the buffering hook and the locking hook of the keycap are disposed within the hollow part, and extended in a direction toward the inner wall.

5. The key structure according to claim 1, wherein the keycap comprises a connection post, and the connection post comprises a lateral wall, wherein the connection post is inserted into the hollow part of the pedestal, and the buffering hook and the locking hook are located beside each other and disposed on the lateral wall in a side-by-side arrangement.

6. The key structure according to claim 5, wherein the keycap further comprises a buffering arm and a position-limiting arm, wherein the buffering arm and the position-limiting arm are located beside each other and disposed on the lateral wall of the connection post in a side-by-side arrangement, wherein the buffering hook is disposed on the buffering arm, and the locking hook is disposed on the position-limiting arm.

7. The key structure according to claim 1, wherein the buffering hook of the keycap comprises a first contact surface, and the locking hook of the keycap comprises a second contact surface, wherein when the buffering hook is contacted with the protrusion part, the first contact surface of the buffering hook is contacted with the protrusion part, wherein when the locking hook is contacted with the protrusion part, the second contact surface of the locking hook is contacted with the protrusion part.

8. The key structure according to claim 7, wherein an area of the first contact surface of the buffering hook is smaller than an area of the second surface of the locking hook.

9. The key structure according to claim 1, wherein the buffering hook is made of soft material.

* * * * *